United States Patent [19]

Sutter

[11] 4,294,048

[45] Oct. 13, 1981

[54] APPARATUS FOR SUPPORTING PIVOTALLY MOUNTED SEATS

[75] Inventor: David L. Sutter, Kennebunkport, Me.

[73] Assignee: Hussey Manufacturing Co., Inc., North Berwick, Me.

[21] Appl. No.: 118,393

[22] Filed: Feb. 4, 1980

[51] Int. Cl.[3] ..... E04H 3/12; A47C 1/12

[52] U.S. Cl. ..... 52/9; 297/232; 297/331

[58] Field of Search ..... 52/8–10; 297/232, 331

[56] References Cited

U.S. PATENT DOCUMENTS

| | | | |
|---|---|---|---|
| 619,153 | 2/1899 | Egan et al. | 297/232 X |
| 3,352,069 | 11/1967 | Curra | 52/9 |
| 3,443,835 | 5/1969 | Brunskole | 52/9 X |
| 3,584,414 | 6/1971 | Bahnsen | 49/272 |
| 3,880,464 | 4/1975 | Murphy et al. | 297/331 X |
| 4,063,392 | 12/1977 | Van Rym et al. | 52/9 |
| 4,155,202 | 5/1979 | Hartman | 52/9 |
| 4,189,876 | 2/1980 | Crossman et al. | 52/9 |
| 4,211,450 | 7/1980 | Sutter | 52/9 X |

*Primary Examiner*—J. Karl Bell

[57] ABSTRACT

Apparatus is provided for setting up and collapsing long rows of seats for stadiums or auditoriums, wherein each seat is provided with gravity counter-balancing spring means such that setting up or collapsing an extended row of seats may be done from one end of the row with a minimum of distortion along the row or force required. Provision is made for automatic operation by means of a small electric motor which may be remotely controlled. Additional provision is made for locking each set of an extended row of seats in either the set up or collapsed positions and for unlocking them in response to the initial action of means for changing the seats from one position to the other.

12 Claims, 11 Drawing Figures

APPARATUS FOR SUPPORTING PIVOTALLY MOUNTED SEATS

FIELD OF THE INVENTION

The present invention relates to stadium and auditorium seating in which rows of seats are mounted on platforms with the seats being collapsible onto the platforms, and the platforms being movable into a nested position as for example within a wall recess at the side of a playing field or auditorium, as described generally in U.S. Pat. No. 3,352,069. More particularly, the invention relates to mechanisms for raising such rows of seats to the set up position, for lowering them to the collapsed position, and for locking them in place in either position. Additionally, the invention relates to doing it automatically.

BACKGROUND OF THE INVENTION

Many stadiums and auditoriums are used for multiple purposes involving differing seating and floorspace demands. For example, many outdoor stadiums are used alternately for football, baseball, and track; and indoor auditoriums are often used for theatrical shows; large meetings, basketball, gymnastics, ballroom dancing, etc., and the seating and space requirements for all such sports and/or activities differ radically. As a result it is highly desirable to provide roll-away seating so that space can be cleared for one activity, or extra seating provided for another.

An important aspect of changing the seating provisions of stadiums and auditoriums is the time and labor required to effect the change. For example, an afternoon football game may be followed by a night baseball game and it may be necessary to make a major change in the short period of an hour or two. To be able to do it rapidly and with a minimum of labor is highly desirable.

Another important consideration is security of structure and safety of personnel. The seating must be readily collapsible, but it must not be so easily collapsed that the occupants can do it inadvertently during normal use. In addition, once the seats have been collapsed for stowage, unless they remain securely in the collapsed position, they can be damaged during the telescoping stowage operation.

Still another factor has to do with the weight of long rows of seats. In general, stadium seats weigh about 25 lbs. Thus, a row of, say, 14 seats will weigh 350 lbs., i.e., too much weight for a single man to lift or even to collapse gently from one end of the row, to say nothing of the distortion (twisting) along the row which such weight would impose on the structure. It would, therefore, be highly desirable to provide mechanism whereby raising or lowering an entire extended row of seats may be done by the application of a relatively small force at one end only of the row.

Another factor relates to automatic operation. In a typical modern installation the telescoping platforms are motor driven and can be remotely "push button" controlled by a single operator for moving into place one or more rows of a multi-tiered arrangement. In conjunction with such automatic operation it would also be desirable to provide for automatic "push button" control for raising and lowering the respective rows of seats, and thereby permit a rapid change of state of an auditorium by a single operator.

The present invention, therefore, has as a general object, the provision of means whereby extended rows of seats may be collapsed quickly and easily with a minimum of labor. A further object is to provide such equipment with a substantially tamperproof mechanism for holding extended rows of seat both in the upright and collapsed positions while still permitting quick and efficient release to be performed when desired. Further objects include the provision of gravity counter-balancing for all seats of an extended row whereby long rows of interconnected seats may be raised and lowered from one end only by the application of a relatively small force to the end seat. Other objects relate to the provision of automatic operation such that an entire tier of seats can be either set up or stowed by remote "push button" control.

BRIEF DESCRIPTION OF THE INVENTION

The present invention is applicable to long rows of stadium or auditory seating mounted on automatically or manually movable telescoping platforms. All seats within each row are mounted to pivot in unison from an upright position, set up for use, to a flat, collapsed position lying on the platform. When the seats are in the collapsed position the platforms may be telescoped together in a stowed position at the end of the auditorium or stadium. The individual seats in each row are connected laterally to stanchions to form a unitary row, with the stanchions pivotally connected to the platforms to permit the seats to pivot from the upright position forward to the collapsed position. Internally of each stanchion is a strong compression spring which acts through a camshaft and cam follower, on a cam fixed to the base arranged to apply a lifting force to the seat which effectively counter balances the weight of the chair. The cam is contoured to vary the lifting force from maximum in the collapsed position to zero in the upright position and in general conformance to the gravity of the seat for positions in between. In this way, an entire extended row of seats may be set-up or collapsed by applying a relatively small force only to an end seat of the row without imposing any substantial twisting distortion on the row.

A feature of the invention is the provision of a helical and worm gear drive for controlling the position of the end seat of a row. The control mechanism is located at the base of the end stanchion, and arranged so that the worm gear is driven by a worm mounted on a shaft driven by the helical gear to move the seat from the collapsed position to the upright position and vice versa. The helical gear mates with a second helical gear mounted on an externally extending shaft at right angles to the worm shaft such that rotation of the externally extending shaft acts to raise or lower the seats. The external shaft is located at the base of the end seat near the floor and can be operated manually by the use of a small crank or wrench, or if automatic "push button" control is desired, it can be driven by a small electric motor mounted within the aisle step adjacent to the end seat of a row.

A further feature of the invention relates to locking the seats in the respective upright and collapsed positions. This is accomplished by providing a locking shaft which extends, in interconnecting sections, along the full length of the seat row at the base of the stanchions. Longitudinal motion of the locking shaft in a direction away from the control end positions a locking detent at each stanchion to lock the seats in the upright position, while longitudinal motion of the locking shaft back toward the control end, positions a second locking detent to lock the seats in the collapsed position. Control of the longitudinal motion of the locking shaft is provided through a bell crank pivoted at one end to the locking shaft and at the other end to the worm shaft mentioned above which is arranged to slide longitudinally sufficiently to accommodate the required motion of the locking shaft. The helical gears are arranged to apply both a rotational and longitudinal force to the worm shaft. The longitudinal force causes the worm shaft to move longitudinally and thereby to actuate the locking shaft. The helical gears are of the opposite "hand" to the worm (i.e., the helical gears are right handed if the worm is left handed, or vice versa). This relationship is important because it is highly desirable that the starting force of the gears for a change of position in either direction start by urging the seat more toward the position in which it then is. This has the effect of relieving the pressure between the stanchion ends and the locking detents, and thereby facilitates free sliding action of the locking shaft.

A feature of the locking shaft is that it comprises sections which are adjustably interconnected. This permits the locks at each stanchion to be positioned individually to accommodate minor disconformities which inevitably appear along an extended row of interconnected seats.

An additional feature of the invention is the provision of arm rests for the seats and means for elevating and depressing them as required for the respective upright and collapsed positions. This is accomplished by pivoting the arm rests on the stanchions and interconnecting the upper end of the camshaft within each stanchion to the arm rest in such a position that motion of the camshaft in response to motion of the seat also causes the arm rest to assume the desired position.

BRIEF DESCRIPTION OF THE DRAWINGS

An illustrative embodiment of the invention is shown in the accompanying drawings in which.

DETAILED DESCRIPTION OF THE INVENTION

Figure 1:
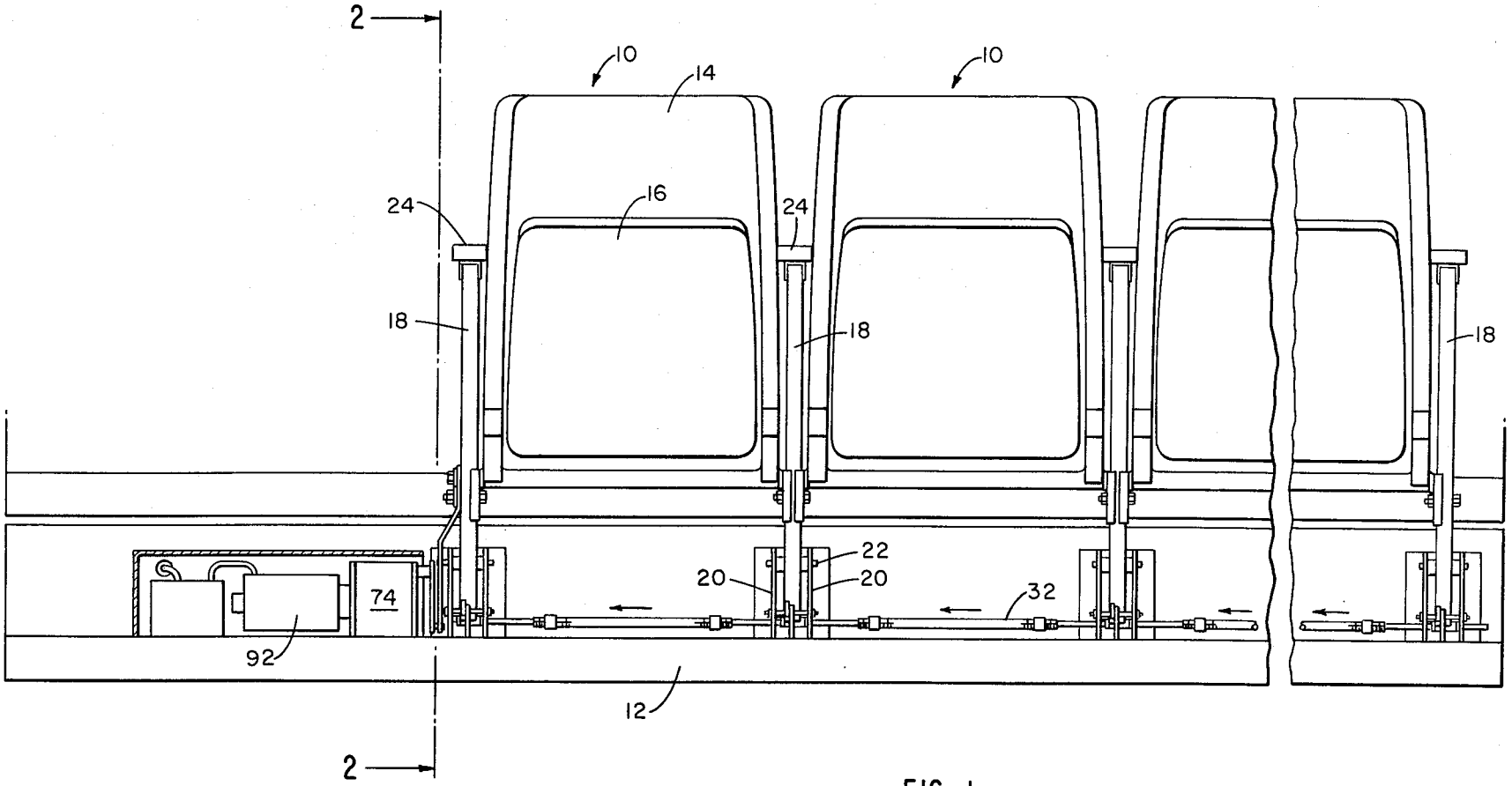
FIG. 1 is a view in front elevation of a row of seats of the invention in the upright position partially broken away at the right to indicate a row incorporating an indefinite number of seats.
Figure 2:
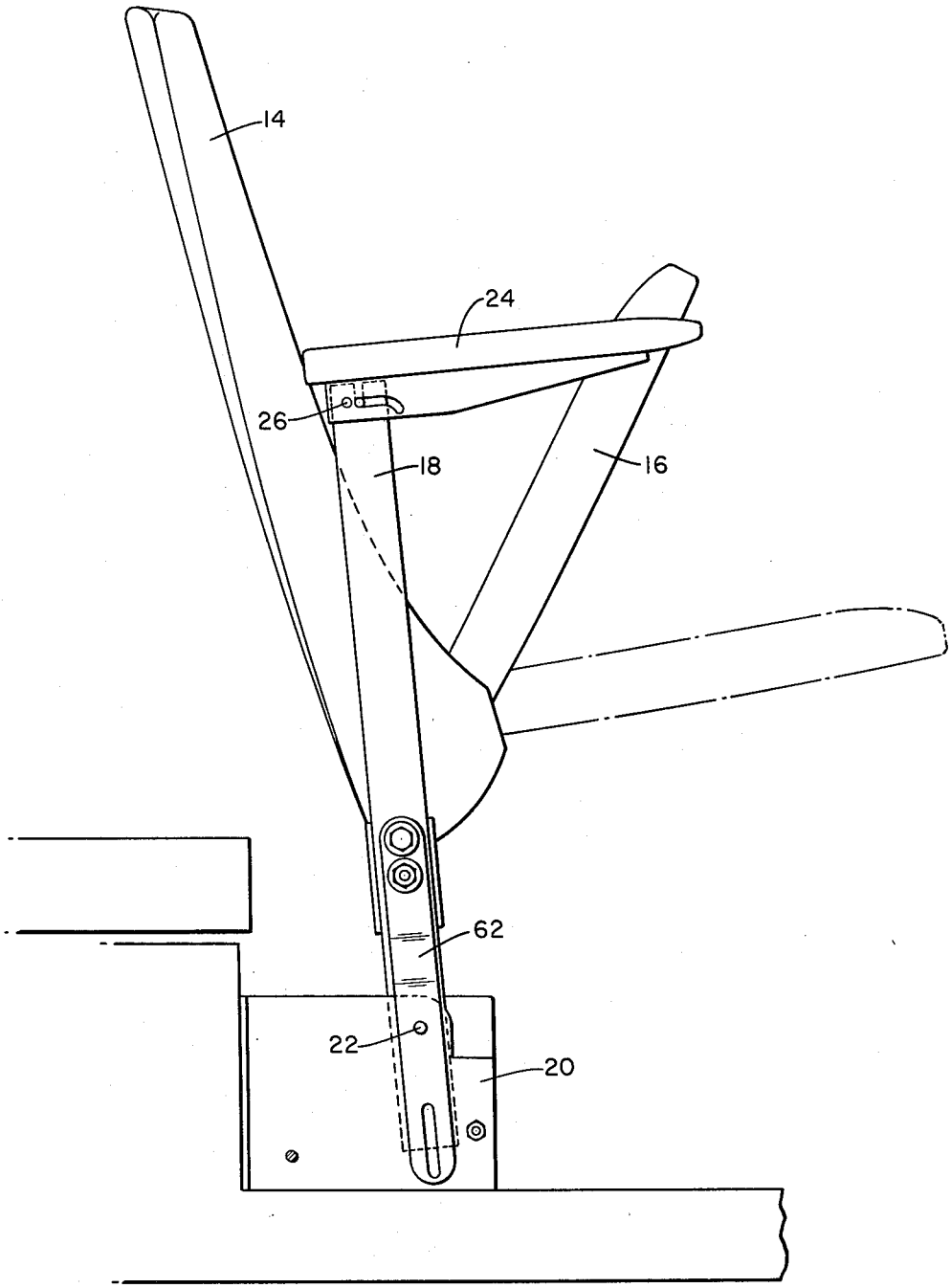
FIG. 2 is a view in side elevation of the end seat of a row in the upright position.
Figure 3:
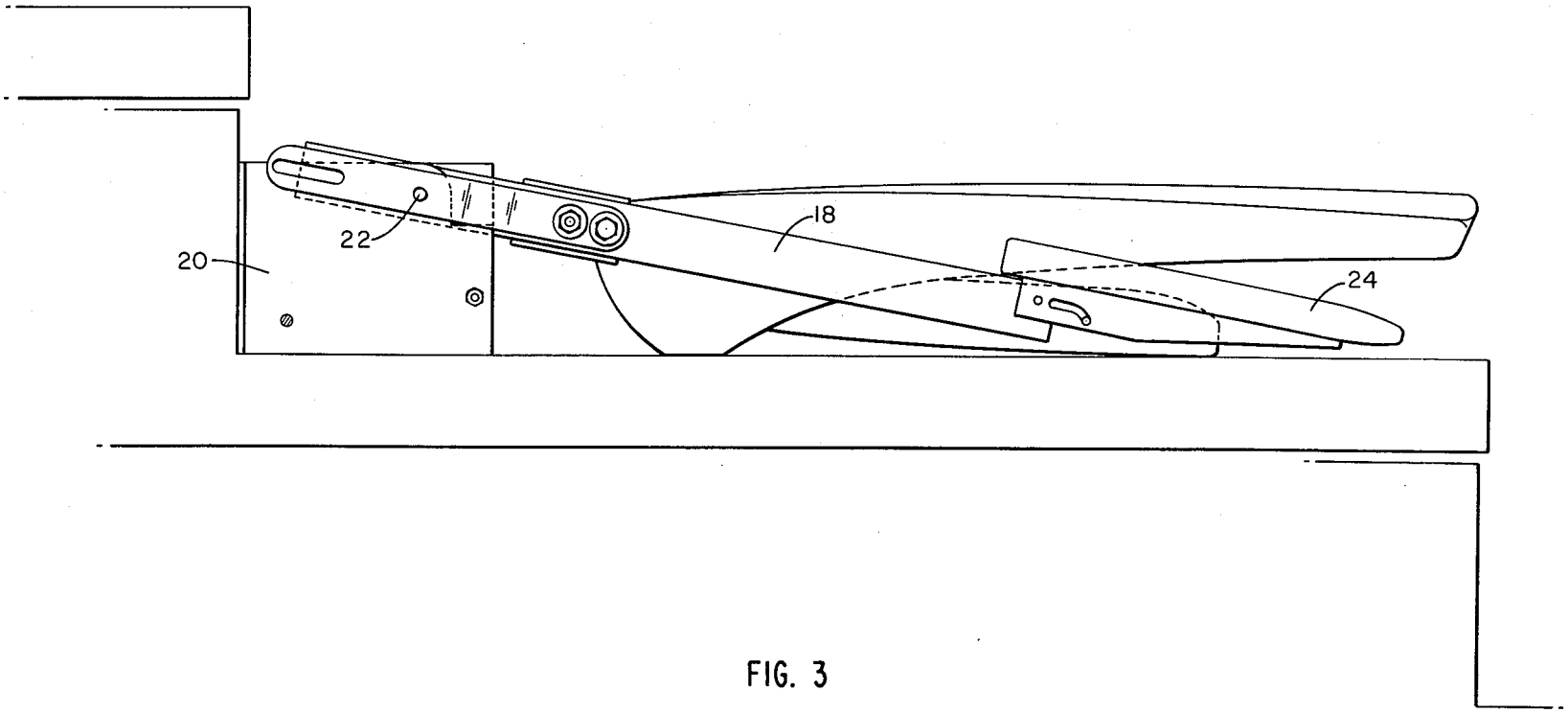
FIG. 3 is a view in side elevation of the end seat of a row in the collapsed position.

An illustrative embodiment of the invention is depicted broadly in FIG. 1 in which seats, indicated generally at 10, are mounted side by side on a base 12 to form an extended row. The seats 10 comprise back rests 14 with seat cushions 16 pivoted thereto (see FIG. 2) with a single stanchion 18 between each seat as well as one at each end of the row. In a usual installation a number of rows of seats 10 mounted on bases 12 will be arranged to form an ascending tier of seat rows with each base 12 mounted on a separate movable platform (not shown) designed to nest in telescoping relation when stowage of the tier is desired. For stowage, the seats 10 are pivoted forward from the upright position shown in FIGS. 1 and 2 to a collapsed position (see FIG. 3) in which the platforms may be nested together in telescoping relation within a minimum of space, the pivotal connection being formed between pairs of base mounting plates 20 and the stanchions 18 by pivot pins 22.

Arm rests 24 are pivotally connected at 26 to the upper extremity of stanchions 18 to pivot from a position at right angles to stanchions 18 when the seat is in the upright position to a position parallel to stanchions 18 when the seat is in the collapsed position. The pivotal action of the arm rest relative to the stanchion is controlled in unison with the change of position of the seats by a linkage mechanism within the stanchion which will be described more in detail below.

Figure 4:
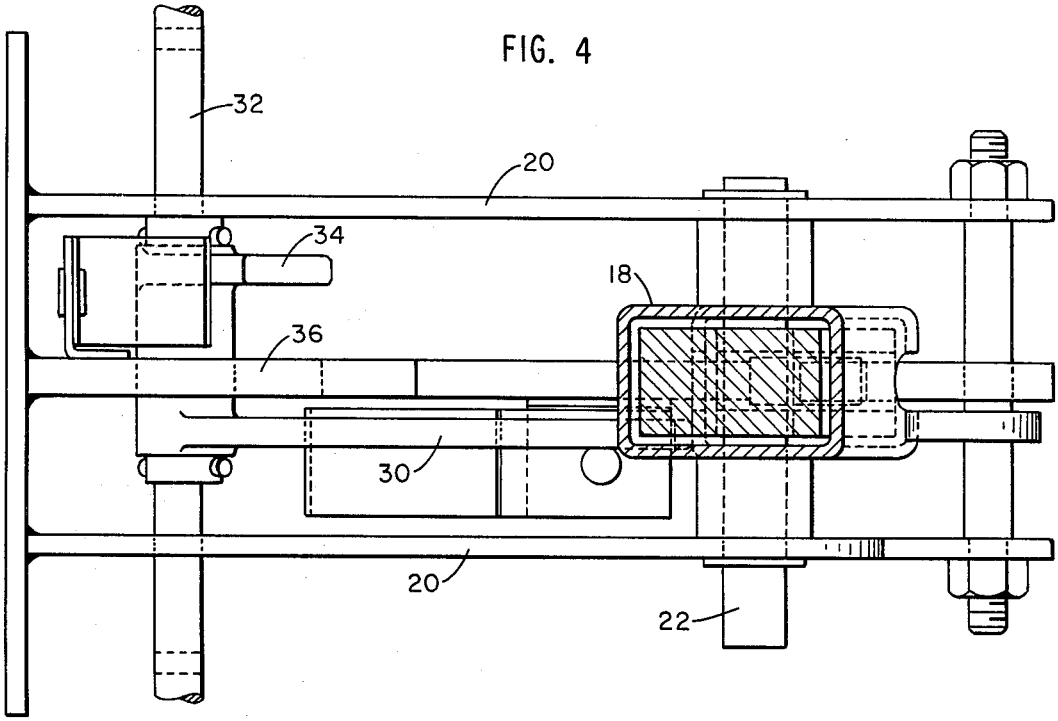
FIG. 4 is a plan view of the pivotal and locking arrangement for each stanchion with the seat in the upright position.
Figure 5:
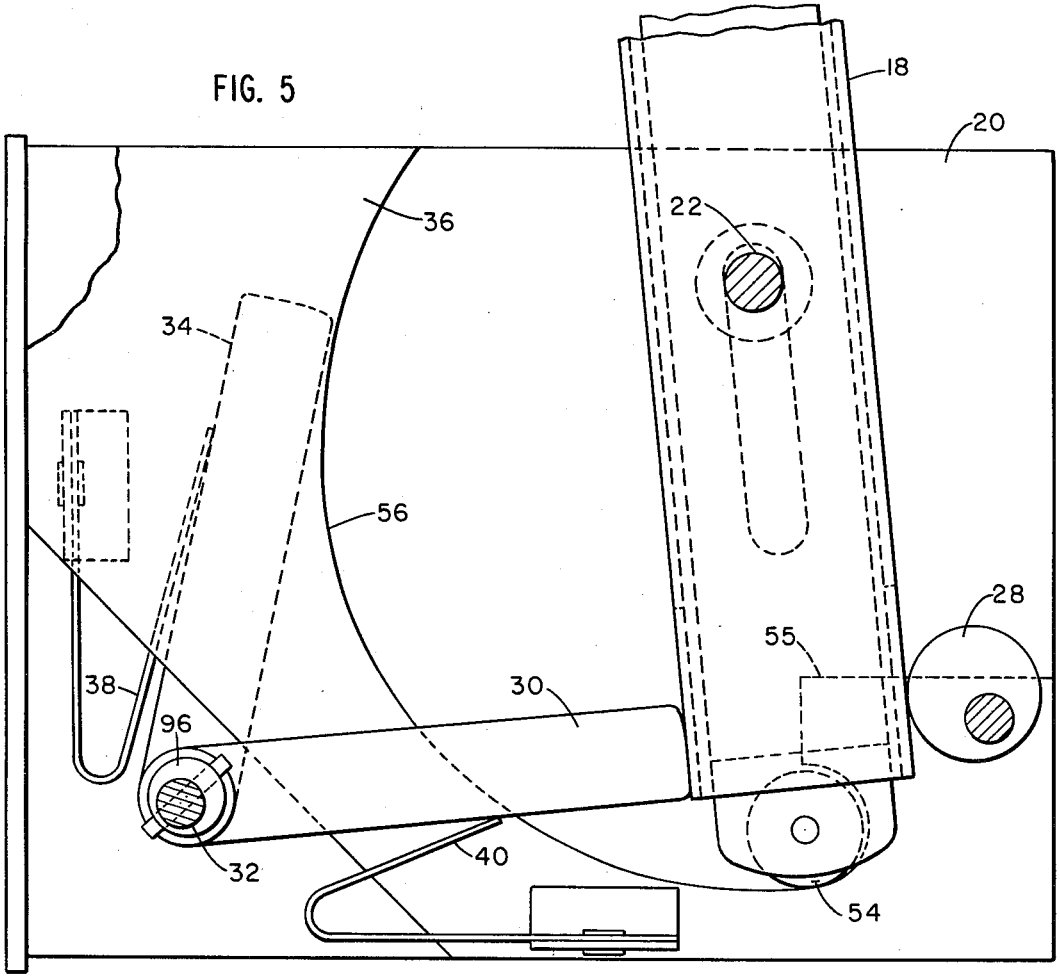
FIG. 5 is a view in side elevation of the pivotal and locking arrangement shown in FIG. 4.
Figure 6:
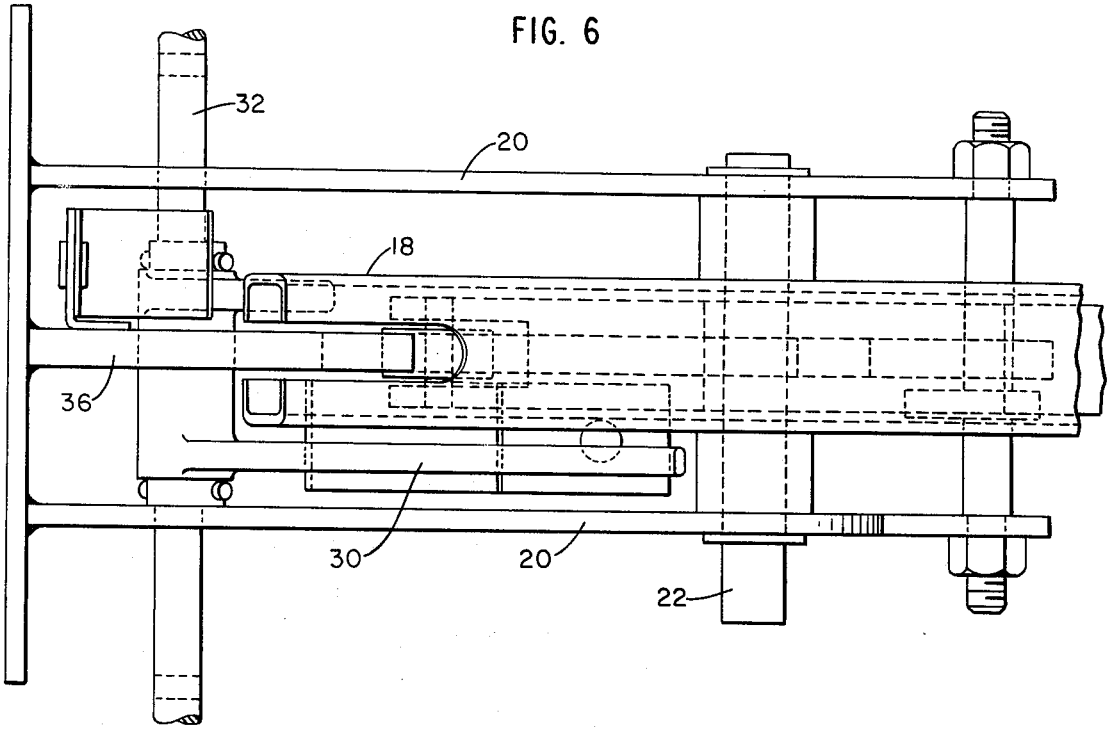
FIG. 6 is a plan view of the arrangement of FIG. 4 with the seat in the collapsed position.
Figure 7:
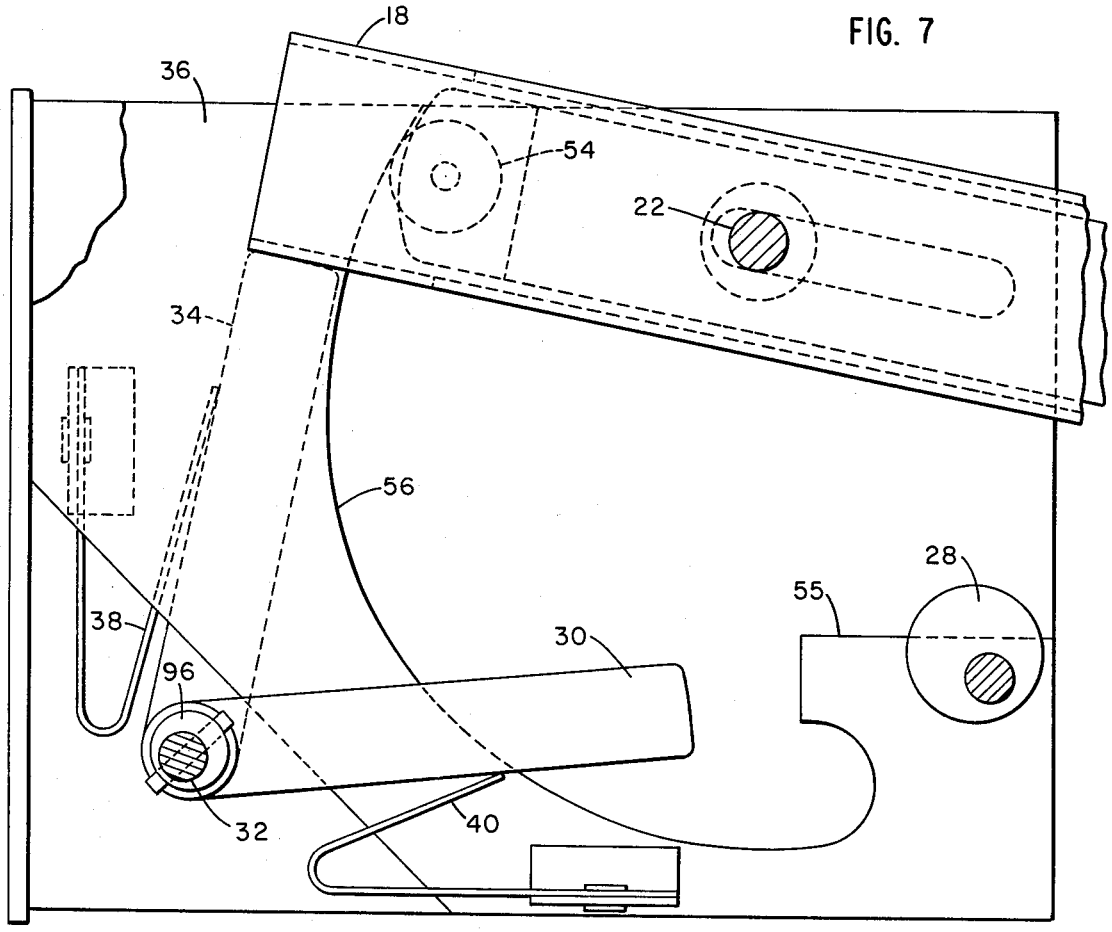
FIG. 7 is a view in side elevation of the pivotal and locking arrangement of FIG. 6.

When the seats are set up for use in the upright position, it is important that they be held securely in that position without risk of accidental collapse while occupied. Also when the seats are in the collapsed position it is important that they remain depressed so as not to interfere with the telescoping action of the platforms during the nesting operation. For these purposes provision is made to lock the stanchions 18 in the respective upright and collapsed positions as may be seen in FIGS. 4–7. In the upright position shown in FIGS. 4 and 5, stanchion 18 is pivoted slightly beyond the vertical with its base in abutting relation with a forward stop member 28. With the stanchion 18 in this position, an upright locking detent 30 abuts the rear face at the lower end of stanchion 18 and locks the stanchion 18 against forward pivotal motion. Locking detent 30 is mounted on a longitudinally movable locking shaft 32 such that when locking shaft 32 is moved away from the left hand end of the row as depicted in FIG. 1 it comes into the locking position for the upright seat position as shown in FIGS. 4 and 5. When it is desired to release locking detent 30 so as to permit stanchion 18 to pivot the seat forward, locking shaft 32 is pulled toward the left (as shown in FIG. 1) such that locking detent 30 no longer abuts the lower end of stanchion 18 thereby leaving it free to pivot forward. With the locking shaft so positioned a collapsed position locking detent 34 is brought into position in the pivotal path of a portion of the lower end of stanchion 18 on the opposite side of a cam plate 36 which is located centrally between the stanchion supporting plates 20 in the plane of the center line of the stanchion 18. When the stanchion 18 is then pivoted to the collapsed position it first contacts the side of locking detent 34 and pivots it to the rear against the force of spring 38 until the lower end of stanchion 18 passes freely beyond the end of locking detent 34, at which point, locking detent 34 snaps back from the force of spring 38 with its end in abutting relation with the forward (then downward) face of the end of stanchion 18. In this position locking detent 34 prevents the seats from rising from the collapsed condition. By shifting the longitudinal position of the locking shaft 32, however, locking detent 34 may be removed from abutment with stanchion 18, thereby leaving the seat free to rise to the upright position. When this is done, locking detent 30 is restored to the position of FIG. 4 in the path of part of the lower end of stanchion 18 such that stanchion 18 contacts the side of locking detent 30 and depresses same against spring 40 until moving beyond the end of locking detent 30 at which point spring 40 snaps locking detent 30 into its locking position of abutment against the rear face at the lower end of stanchion 18. Some or all of the stanchions of a long row of seats may be provided with such locking arrangements, thereby permitting the rows to be locked in either position as desired, and released by the simple action of the locking shaft from one end of the row.

Figure 11:
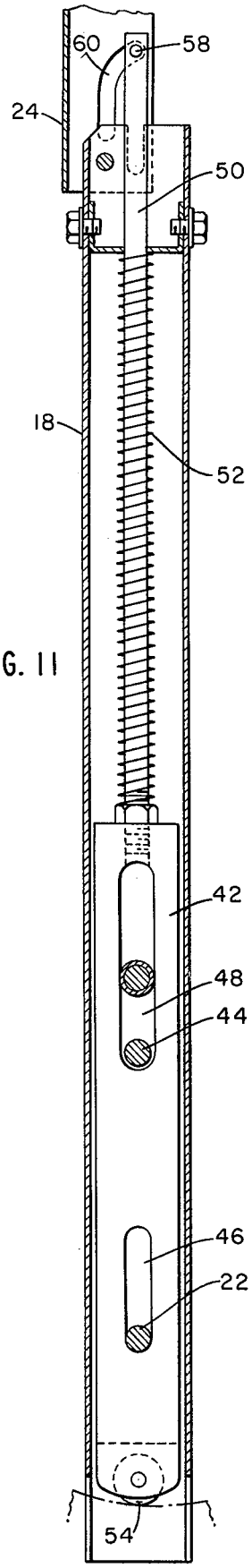
FIG. 11 is a cross-sectional view in side elevation of one of the stanchions showing the internal camshaft, the compression spring, the cam follower at the lower end and the connection to the arm rest at the upper end.

In order to permit an extended row of seats to be moved by action at one end only of a row, from the collapsed position to the upright position (and vice versa) without introducing torsional distortion into the row, or requiring heavy forces, provision is made to counterbalance the gravity of the respective chairs by a spring and cam arrangement shown in FIGS. 4–7 and 11. Referring first to FIG. 11, internally of stanchion 18, a camshaft 42 is mounted to slide longitudinally on pivot pin 22 and a second pin 44 fitting in slots 46 and 48 respectively of camshaft 42. Camshaft 42 is provided with an upper rod extension 50 which centers a compression spring 52 which is arranged to urge camshaft 42 downwardly. A rotatably mounted cam follower 54 is provided at the extremity of camshaft 42.

Cam follower 54 bears against cam face 56 of cam plate 36 which is contoured so that when the seat is in the collapsed position (see FIG. 7) cam follower 54 and cam face 56 cooperate in response to the force of spring 52 to urge the end of stanchion 18 downward and thereby to lift the seat. In a typical installation in which the seat weighs 25 lbs., a starting spring force of 200 lbs. is adequate to provide a substantial counterbalancing effect of the gravity of the seat. As the seat is raised from the collapsed position, cam follower 54 follows along cam face 56, camshaft 42 moves in the direction of cam face 56, and the compression of spring 52 becomes less. Also the angle of cam face 56 gradually becomes closer to normal to the axis of stanchion 18, such that the lifting force resulting from the interaction of cam face 56 and cam follower 54 gradually reduces as the seat rises. The amount of this reduction roughly parallels the change in pivotal force of the gravity of the seat, as the seat becomes more erect. In the fully upright position (see FIG. 5) the cam face 56 is normal to the axis of stanchion 18 and, therefore, in that position the force of spring 52 has no effect on the position of the seat.

Rod 50 is adapted to extend through the top of stanchion 18 at which point it is slidably connected to arm rest 24 by a pin 58 on rod 50 sliding in slot 60 in the arm rest 24. Since rod 50 is pushed outwardly of stanchion 18 to its fullest extent when cam follower 54 is at the top of the stroke with the seat in the fully collapsed position (see FIG. 7), at which point arm rest 24 needs to lie more or less parallel to the base 12, the geometry of the connection between rod 50 and arm rest 24 is calculated to pivot arm rest 24 to a position of parallelism with stanchion 18 when rod 50 is fully extended. Conversely, when rod 50 is fully retracted in response to moving the seat to the upright position, rod 50 pivots arm rest 24 downwardly to the horizontal position. At this point, cam follower 54 comes under a detent 55 which serves the purpose of holding the arm rest down in the horizontal position while the seat is in the upright position.

Figure 10:
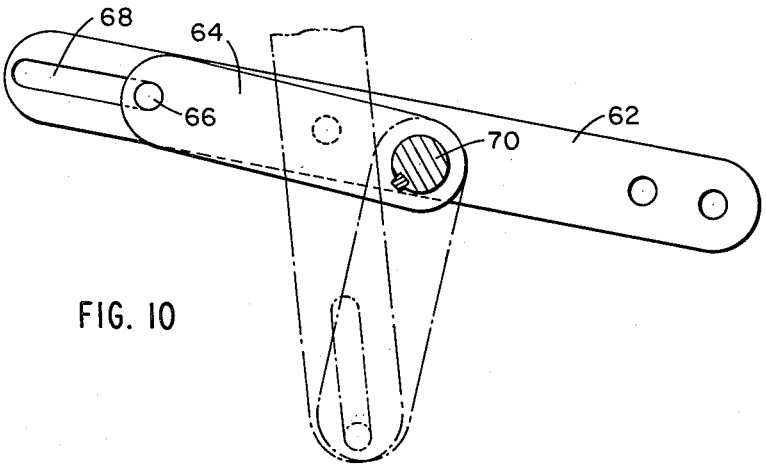
FIG. 10 is a view in side elevation of a crank through which the worm gear acts upon the lower end of the stanchion of the end seat of a row.

Apparatus for releasing the locking mechanism and for applying a lifting force to the end seat of a row is shown in the lower left corner of FIG. 1, and comprises a pivot arm 62 bolted to the end stanchion 18 and also pivoted at pin 22. A drive crank 64 having a drive pin 66 fitting in slot 68 of pivot arm 62, serves to drive pivot arm from the upright position shown in broken lines in FIG. 10 to the collapsed position shown in solid lines in FIG. 10.

Figure 8:
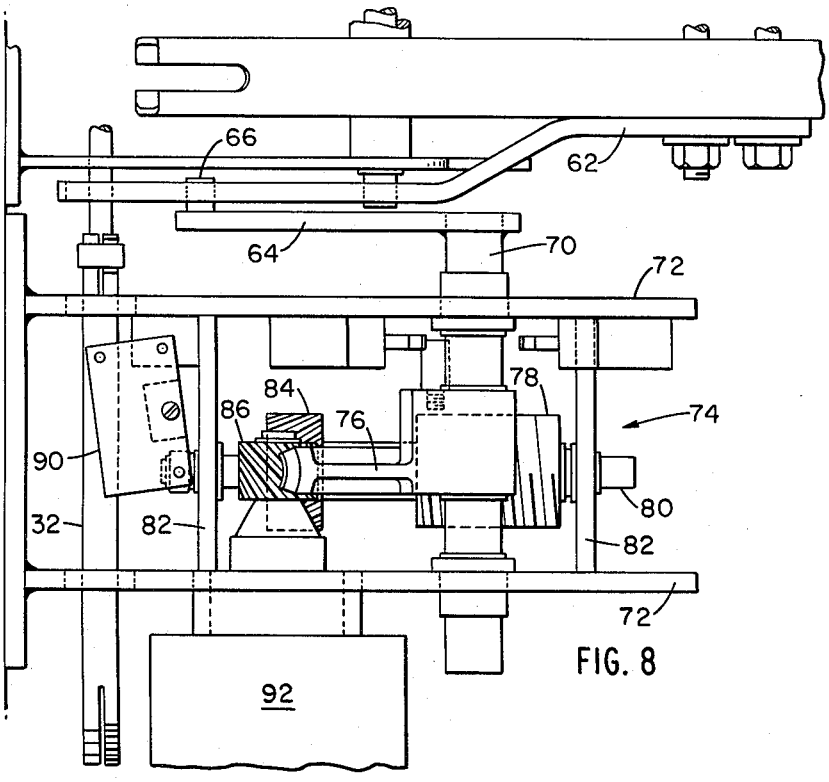
FIG. 8 is a plan view of the helical, worm gear drive and bell crank mechanism for controlling the position of the seats and locking arrangement.
Figure 9:
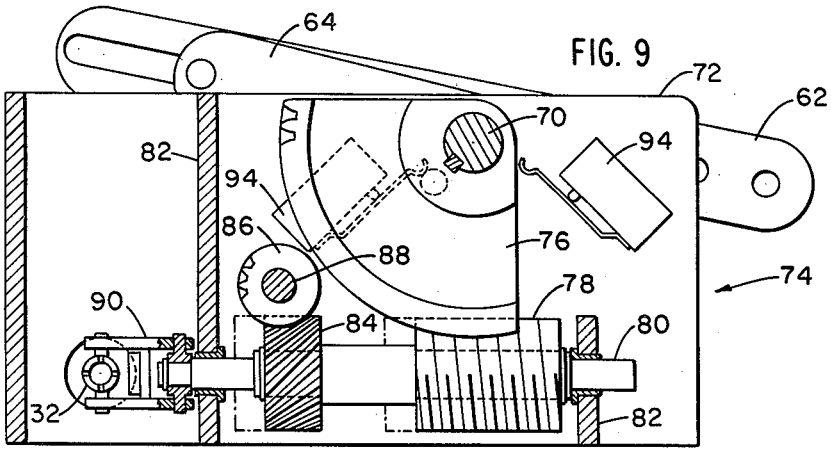
FIG. 9 is a view in side elevation of the arrangement of FIG. 8.

Crank 64 is mounted on a crank shaft 70 journalled in side walls 72 of a gear box indicated generally at 74. Crank shaft 70 is driven by a worm gear 76 which is in turn driven by a worm 78 mounted on a longitudinally movable worm shaft 80 which is journalled in transverse walls 82 of gear box 74. A worm shaft helical gear 84 is mounted on worm shaft 80, and by virtue of being operatively engaged with a drive helical gear 86 mounted on a helical gear drive shaft 88 at right angles to worm shaft 80, drives worm shaft 80. Due to the crossed arrangement of the gears, the application of a driving torque to helical gear drive shaft 80 applies both torque and longitudinal thrust to move shaft 80. In addition, helical gear 84 and worm 78 are of opposite hand (i.e. if gear 84 is right handed, worm 78 is left handed, and vice versa). Thus, the application of driving torque to shaft 88 results in driving worm 78 in a direction which initially urges the seats more into the position in which they then are and to drive shaft 80 longitudinally to the opposite position in which it then is. This relationship of the forces is employed to release the locking mechanism by actuating locking shaft 32 longitudinally through a bell crank 90, one end of which is connected to worm shaft 80 and the other end of which is connected to locking shaft 32. Thus, when helical gear drive shaft 88 is rotated, as for example with the seats in the collapsed position as in FIGS. 8 and 9, initially worm 78 urges worm gear 76 to cause the seats to move more toward the collapsed position, and also urges worm shaft 80 to the rear so as to extend shaft 32. In this way pressure between the end of stanchions 18 and locking detents 34 all down the row is relieved and locking shaft 32 freely slides so as to move locking detents 34 out of the path of the ends of stanchions 18. Thereafter when worm shaft comes to the end of its stroke within gear box 74, further torque on shaft 88 drives worm 78 in a direction which causes the seats to rise to the upright position.

Due to the counterbalancing effect of the spring and cam arrangement, the force to be applied at shaft 88 is relatively light and can be supplied by hand through a small crank a wrench, or by a light electric motor 92 (see FIG. 1). If an electric motor is employed, microswitches 94 may be employed to interrupt the drive in the respective directions to prevent over travel. In addition, push button control from a remote station may be employed.

Since disconformities between seats in an extended row are virtually impossible to eliminate, and since a minor amount of torsional distortion will take place along the row due to the fact that the spring force does not totally counterbalance all of the effective weight of the seats (all but a few pounds), it is desirable to provide for individual adjustment for the positions of locking detents 30 and 34. This is done by mounting detents 30 and 34 on an eccentric bushing 96 such that, by rotating and bolting in place sections of locking shaft 32 in the area of the detents 30 and 34, the detents may be respectively raised and/or lowered to conform to the particular seat, and thereafter held in place.

It will now be seen that the arrangement of the invention which provides for locking the seats in both the upright and collapsed positions has a specific cooperative relationship with the gravity counterbalancing arrangement of the invention, in that the force of the seats urging them to rise from the collapsed position is prevented from accidentally lifting the seats when it is desired to keep them down, especially during a storage operation involving telescoping movable platforms bearing the seats. In addition, the cooperative relationship between the elements whereby the lifting or depressing force (as the case may be) also provides the force needed for unlocking the seats is important, as is the operational tie-in between the gravity counterbalancing action of the camshaft and the positioning of the arm rests. It is, therefore, my intention to claim these features broadly and independently of the specific details of the illustrative embodiment herein described. In fact, the arrangement whereby the applied turning force acts initially to release a lock before acting to pivot the chairs is believed to be inventive in itself and applicable to other things besides chairs, such as doors or the like wherein a sequence of two actions as for instance in locking and opening followed by locking in the fully opened position, and the reverse, are desired. In addition, it will be appreciated that an economy installation may be arranged without any gear box at all with manual operation being provided for locking shaft 32. With such an arrangement, the seats will be raised and lowered manually, which can be done easily by a single operator from the aisle end of the row. Additional modifications of the invention will be apparent to those skilled in the art and therefore it is not intended to confine the invention to the precise form herein shown but rather to limit it only in terms of the appended claims.

I claim:

1. Apparatus for supporting an extended row of adjoining seats to pivot on a base in unison between an upright and a collapsed position comprising:

(a) means for applying pivotal force to each seat which is substantially equal and opposite to the pivotal force on the seat of the weight of the seat in any position between and including the upright and collapsed positions, and (b) releasable means for locking the row of seats respectively in the upright and collapsed positions.

2. The apparatus defined in claim 1 further characterized by:

(c) means for applying respectively lifting or depressing force to the end seat of said row depending upon whether the row is in the collapsed or upright position, whereby upon the release of 1-(b), the position of all seats of the row may be changed by action at one end only of the row.

3. The apparatus defined in claim 2 further characterized by:

(d) means actuated by 2-(c) for releasing 1-(b).

4. The apparatus defined in claim 2 further characterized by:

(e) stanchions supporting the seats pivoted to the base near the lower extremity of said stanchions, (f) a cam mounted on said base adjacent to the lower extremity of each stanchion, (g) a camshaft operatively associated with each said stanchion, (h) a cam follower on each camshaft in operative engagement with said cam, and (i) spring means within each said stanchion acting on said camshaft to supply through interaction of 4-(f) and 4-(h), the force defined in 1-(a).

5. The apparatus defined in claim 1 further characterized by:

(j) element 1-(b) including a rod extending along said base the full length of said row and means for locking each seat as defined in 1-(b) operatively engaging said rod.

6. The apparatus defined in claim 4 further characterized by:

(k) an arm rest pivotally mounted on each said stanchion, and (l) means operatively connected to said camshaft for lowering said arm rest when said seat is in the upright position and for raising the arm rest when said seat is in the collapsed position.

7. Apparatus for supporting seats to pivot on a base between an upright and a collapsed position comprising:

(a) means for applying a pivotal force to the seat which is substantially equal and opposite to the pivotal force on the seat of the weight of the seat in any position between and including the upright and collapsed positions, and (b) releasable means for locking the seat respectively in the upright and collapsed positions.

8. The apparatus defined in claim 7 further characterized by:

(c) means for applying respectively lifting or depressing force to the seat depending upon whether the seat is in the collapsed or upright position, whereby upon the release of 7-(b), the position of the seat may be changed.

9. The apparatus defined in claim 2 further characterized by:

(d) means actuated by 8-(c) for releasing 7-(b).

10. The apparatus defined in claim 8 further characterized by:

(e) stanchions supporting the seat pivoted to the base near the lower extremity of said stanchions, (f) a cam mounted on said base adjacent to the lower extremity of each stanchion, (g) a camshaft operatively associated with at least one said stanchion, (h) a cam follower on each camshaft in operative engagement with said cam, and (i) spring means within each said stanchion acting on said camshaft to supply through interaction of 10-(f) and 10-(h), the force defined in 7-(a).

11. The apparatus defined in claim 7 further characterized by:

(j) element 7-(b) including a rod extending along said base and means for locking the seat as defined in 7-(b) operatively engaging said rod.

12. The apparatus defined in claim 10 further characterized by:

(k) an arm rest pivotally mounted on each said stanchion, and (l) means operatively connected to said camshaft for lowering said arm rest when said seat is in the upright position and for raising the arm rest when said seat is in the collapsed position.

* * * * *